US007040740B2

(12) United States Patent
Hu et al.

(10) Patent No.: US 7,040,740 B2
(45) Date of Patent: May 9, 2006

(54) FLUID INJECTOR AND METHOD OF MANUFACTURING THE SAME

(75) Inventors: Hung-Sheng Hu, Kaohsiung (TW); Wei-Lin Chen, Taipei (TW); In-Yao Lee, Shijr (TW); Tsung-Ping Hsu, Jungli (TW); Chung-Cheng Chou, Taipei (TW); ShangShi Wu, Chiai (TW)

(73) Assignee: Benq Corporation, Taoyuan (TW)

( * ) Notice: Subject to any disclaimer, the term of this patent is extended or adjusted under 35 U.S.C. 154(b) by 89 days.

(21) Appl. No.: 10/618,928

(22) Filed: Jul. 11, 2003

(65) Prior Publication Data

US 2004/0183865 A1 Sep. 23, 2004

(30) Foreign Application Priority Data

Jul. 12, 2002 (TW) ..... 91115599 A

(51) Int. Cl.
*B41J 2/05* (2006.01)

(52) U.S. Cl. ..... 347/63

(58) Field of Classification Search ..... 347/20, 347/44, 47, 54, 56, 63; 34/61, 63
See application file for complete search history.

(56) References Cited

U.S. PATENT DOCUMENTS 6,019,457 A * 2/2000 Silverbrook ..... 347/65
6,102,530 A 8/2000 Kim et al.
6,398,348 B1 * 6/2002 Haluzak et al. ..... 347/63

* cited by examiner

*Primary Examiner*—An H. Do
(74) *Attorney, Agent, or Firm*—Ladas & Parry LLP

(57) ABSTRACT

A fluid injector and method of manufacturing the same. The fluid injector includes a base, a first through hole, a bubble generator, a passivation layer, and a metal layer. The base includes a chamber and a surface. The first through hole communicates with the chamber, and is disposed in the base. The bubble generator is disposed on the surface near the first through hole, and is located outside the chamber. The passivation layer is disposed on the surface. The metal layer defines a second through hole, and is disposed on the passivation layer outside the chamber. The second through hole communicates with the first through hole.

22 Claims, 9 Drawing Sheets

FLUID INJECTOR AND METHOD OF MANUFACTURING THE SAME

BACKGROUND OF THE INVENTION

1. Field of the Invention

The invention relates to a fluid injector and a method of manufacturing the same; in particular, a fluid injector with enhanced efficiency and lifetime.

2. Description of the Related Art

Normally, a fluid injector is applied in an inkjet printer, a fuel injector, and other devices. Among inkjet printers presently known and used, injection by a thermally driven bubble has been most successful due to its simplicity and relatively low cost.

FIG. 1 is a conventional monolithic fluid injector 1 as disclosed in U.S. Pat. No. 6,102,530. A structural layer 12 is formed on a silicon substrate 10. A fluid chamber 14 is formed between the silicon substrate 10 and the structural layer 12 to receive fluid 26. A first heater 20 and a second heater 22 are disposed on the structural layer 12. The first heater 20 generates a first bubble 30 in the chamber 14, and the second heater 22 generates a second bubble 32 in the chamber 14 to eject the fluid 26 from the chamber 14.

The monolithic fluid injector 1 includes a virtual valve, and is arranged in high-density. Furthermore, the monolithic fluid injector 1 exhibits low intermixing and low heat-loss. In addition, there is no need to connect an additional nozzle plate with the monolithic fluid injector. As a result, the cost of the monolithic fluid injector 1 can be lower.

However, in the conventional monolithic fluid injector 1, the structural layer 12 mainly consists of silicon oxide with low stress. During manufacture, the thickness of the structural layer 12 is kept within a predetermined range; therefore, the lifetime of the whole structure of the conventional monolithic fluid injector 1 is also limited. Furthermore, since the thickness of the structure layer 12 is insufficient, the injection direction of injecting fluid cannot be consistent. In addition, since the heaters 20, 22 are located on the structural layer 12, most of the heat generated by the heaters 20, 22 can be conducted to the fluid 26 in the chamber 14. However, some of the residual heat generated by the heaters 20, 22 remains and accumulates in the structural layer 12, and operation of the whole system is affected.

SUMMARY OF THE INVENTION

In order to address the disadvantages of the aforementioned fluid injector, the invention provides a fluid injector with enhanced efficiency and lifetime.

Accordingly, the invention provides a fluid injector. The fluid injector comprises a base, a first through hole, a bubble generator, a passivation layer, and a metal layer. The base includes a chamber and a surface. The first through hole communicates with the chamber, and is disposed in the base. The bubble generator is disposed on the surface near the first through hole, and is located outside the chamber of the base. The passivation layer is disposed on the surface. The metal layer defines a second through hole, and is disposed on the passivation layer outside the chamber. The second through hole communicates with the first through hole.

In a preferred embodiment, the metal layer includes a plurality of fins on a surface away from the base to assist the metal layer in heat dissipation.

In another preferred embodiment, the diameter of one end, communicating with the first through hole, of the second hole is substantially larger than that of the other end of the second through hole.

In another preferred embodiment, the fluid injector further comprises an adhesion layer. The adhesion layer is disposed between the base and the metal layer, and assists in adhesion between the metal layer and the base.

It is understood that the adhesion layer is Al, and the metal layer is Ni—Co alloy, Au, or Au—Co alloy.

In another preferred embodiment, the structural layer defines a third through hole, and the passivation layer defines a fourth through hole corresponding to the third through hole, and the metal layer is directly connected with the silicon substrate via the fourth through hole.

In another preferred embodiment, the structural layer defines a third through hole, and the passivation layer defines a fourth through hole corresponding to the third through hole, and the base further comprises an adhesion layer. The adhesion layer is disposed on the structural layer, and is located between the passivation layer and the structural layer. The adhesion abuts the silicon substrate via the third through hole, and abuts the metal layer via the fourth hole to assist in adhesion between the metal layer and the silicon substrate.

In this invention, a method for manufacturing a fluid injector is also provided. The method comprises the following steps. First, a wafer is provided, and a structural layer is formed on the wafer, a chamber is defined between the wafer and the structural layer. Then, a bubble generator is disposed on the structural layer, outside the chamber. Subsequently, a passivation layer is formed on the structural layer, and a metal layer is formed on the passivation layer. Finally, a first through hole is formed on the structural layer, and the first through hole communicates with the chamber.

It is understood that the bubble generator is covered by the metal layer, and the metal layer is coated on the passivation layer by electroforming, electroless plating, physical vapor deposition (PVD), or chemical vapor deposition (CVD), and the structural layer is silicon oxide.

In a preferred embodiment, the method further comprises a step of forming a second through hole in the metal layer. The second through hole communicates with the first through hole.

In another Preferred embodiment, the method further comprises the following steps. A third through hole is formed in the structural layer after the structural layer is formed on the wafer, and an adhesion layer is formed on the structural layer to be connected with the wafer via the third through hole.

In another preferred embodiment, the method further comprises the following steps. A third through hole is formed in the structural layer after the structural layer is formed on the wafer, and an adhesion layer is formed on the structural layer to be connected with the wafer via the third through hole.

BRIEF DESCRIPTION OF THE DRAWINGS

The invention is hereinafter described in detail with reference to the accompanying drawings in which.

DETAILED DESCRIPTION OF THE INVENTION

First Embodiment

Figure 2:
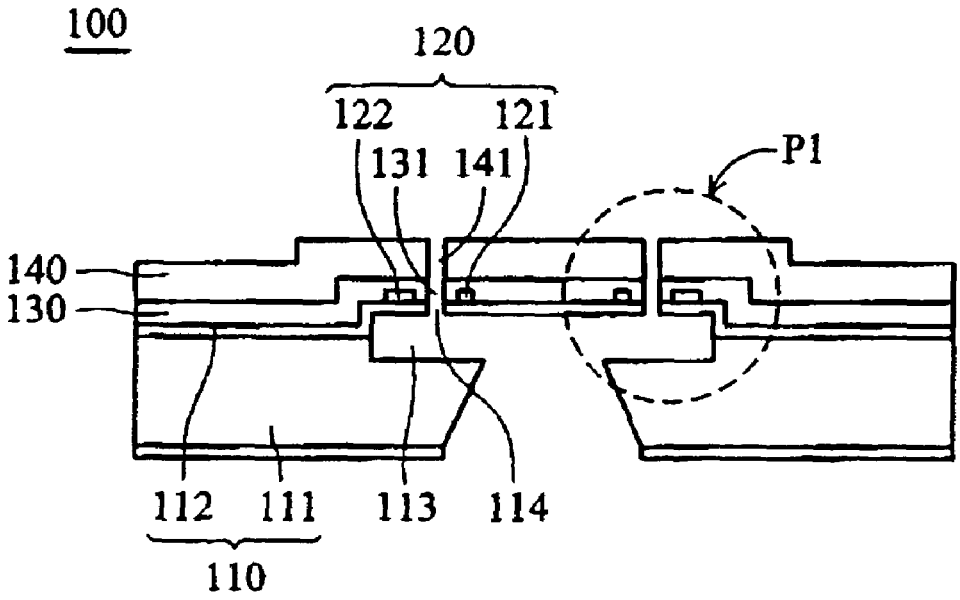
FIG. 2 is a schematic view of a fluid injector as disclosed in a first embodiment of this invention.

Referring to FIG. 2, a fluid injector 100, as disclosed in a first embodiment of this invention, is shown. In this embodiment, the fluid injector 100 comprises a base 110, a first through hole 114, a bubble generator 120, a passivation layer 130, and a metal layer 140.

The base 110 includes a silicon substrate 111 and a structural layer 112. The structural layer 112 is disposed on the silicon substrate 111. A chamber 113 is formed between the silicon substrate 111 and the structural layer 112. The first through hole 114 is formed in the structural layer 112, and communicates with the chamber 113.

Figure 1:
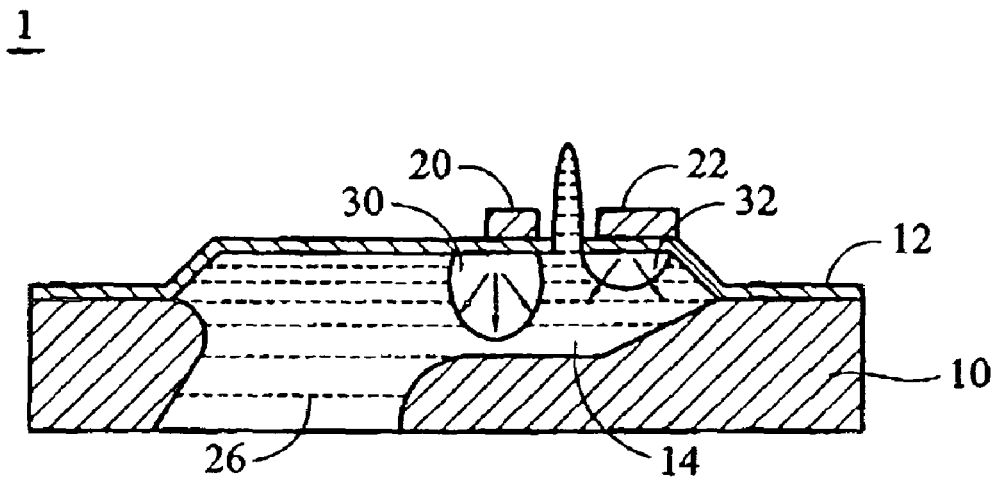
FIG. 1 ( PRIOR ART )
FIG. 1 is a schematic view of a conventional monolithic fluid injector.
Figure 3A:
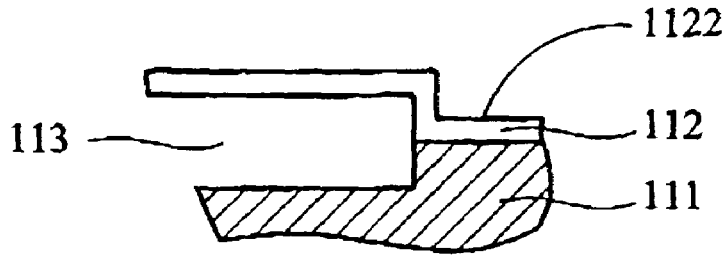
FIG. 3*a*, FIG. 3*b*, FIG. 3*c*, FIG. 3*d*, and FIG. 3*e* are schematic views that show a method for manufacturing the fluid injector as shown in FIG. 2, wherein only a part P1 is shown.

The bubble generator 120 is disposed on a surface 1122 of the structural layer 112 as shown in FIG. 3*a*. The bubble generator 120 is located near the first through hole 114 and outside the chamber 113 of the base 110. In this embodiment, the bubble generator 120 includes a first heater 121 and a second heater 122. Like the heaters shown in FIG. 1, the first heater 120 generates a first bubble in the chamber 113, and the second heater 122 generates a second bubble in the chamber 113 to eject fluid from the chamber 113.

The passivation layer 130 is disposed on the surface 1122 of the structural layer 112, and includes a fifth though hole 131. The metal layer 140 includes a second through hole 141, and is disposed or the passivation layer 130 outside the chamber 113. The second through hole 141 communicates with the first through hole 114 via the fifth through hole 131.

It is understood that the metal layer 140 may be a material with higher heat conductivity, such as Ni—Co alloy, Au, or Au—Co alloy. Furthermore, the structural layer 112 is silicon nitride.

FIG. 3*a*, FIG. 3*b*, FIG. 3*c*, FIG. 3*d*, and FIG. 3*e* are schematic views that show a method for manufacturing the fluid injector 100 as shown in FIG. 2, wherein only a part P1 is shown.

Figure 3B:
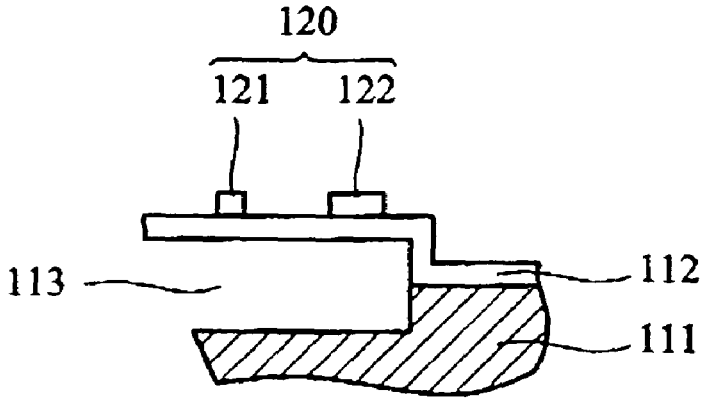
Figure 3C:
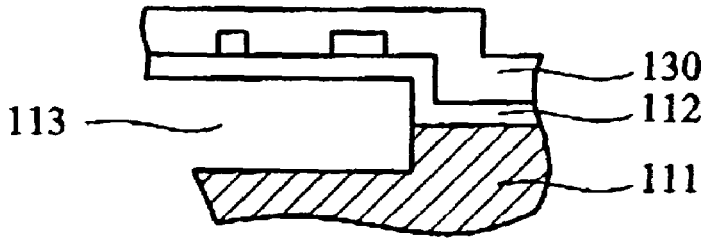
Figure 3D:
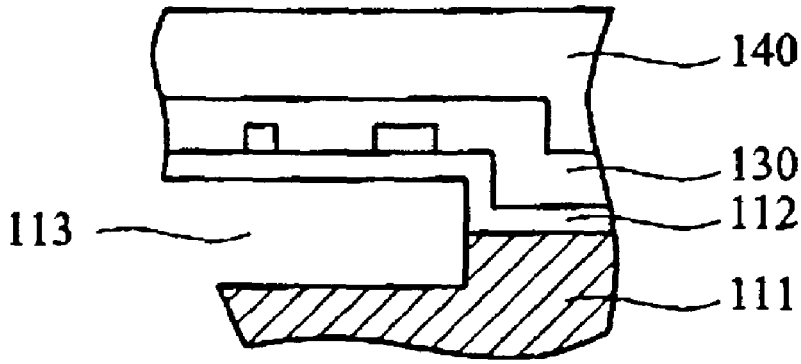
Figure 3E:
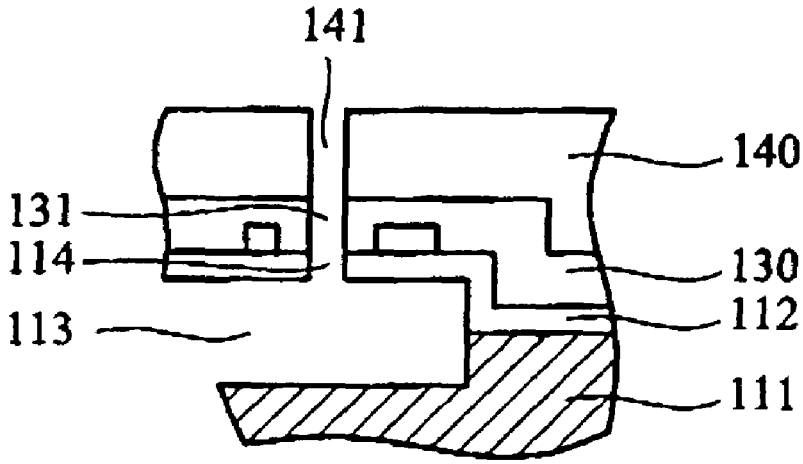

First, a wafer is provided to be used as a silicon substrate 111, with a structural layer 112 is formed thereon, and a chamber 113 is formed between the silicon substrate 111 and the structural layer 112 as shown in FIG. 3*a*. Then, a bubble generator 120 is disposed on the structural layer 112, outside the chamber 113 as shown in FIG. 3*b*. Subsequently, a passivation layer 130 is formed on the structural layer 112 as shown in FIG. 3*c*, and a metal layer 140 is formed on the passivation layer 140 as shown in FIG. 3*d*. Finally, a first through hole 114 is formed on the structural layer 112, and a fifth through hole 131 is formed on the passivation layer 130, and a second through hole 141 is formed on the metal layer 140 as shown in FIG. 3*e*. The first through hole 114, the fifth through hole 131, and the second through hole 141 are communicated with each other, and the first through hole 114 also communicates with the chamber 113.

It is understood that the bubble generator 120 is covered by the metal layer 140, which can be coated on the passivation layer 130 by electroforming, electroless plating, physical vapor deposition (PVD), or chemical vapor deposition (CVD), and the structural layer is silicon oxide.

As stated above, in the fluid injector as disclosed in this embodiment, since the metal layer with a certain thickness is disposed outside the passivation layer, the structural strength of the whole fluid injector can be enhanced. Furthermore, since the metal layer is provided with higher heat conductivity, the heat remaining in the bubble generator can be transferred away so that operation can be enhanced.

Furthermore, since the length of the infection path of the fluid can be extended by the additional thickness of the metal layer, the injecting direction of the fluid can be more definite.

Figure 4A:
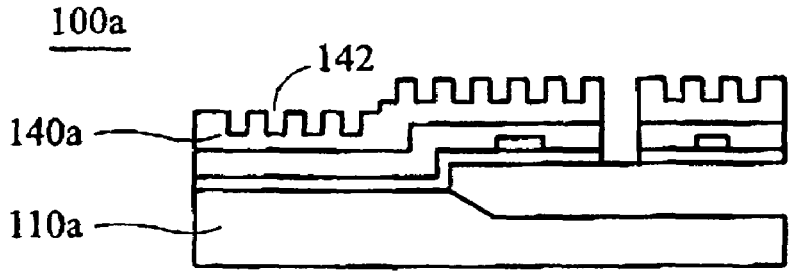
FIG. 4*a* is a schematic view of a variant embodiment of the fluid injector as shown in FIG. 2.

In addition, referring to FIG. 4*a*, a variant embodiment of the fluid injector is shown. In a fluid injector 100*a* as shown in FIG. 4*a*, a metal layer 140*a* includes a plurality of fins 142 on a surface away from the base 110*a* to assist the metal layer 140*a* in heat dissipation. It is understood that the fins 142 can be formed on part of the surface of the metal layer 140*a*.

Figure 4B:
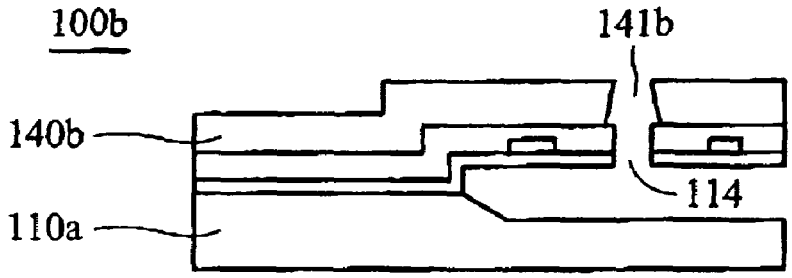
FIG. 4*b*, FIG. 4*c*, and FIG. 4*d* are schematic views of another variant embodiment of the fluid injector as shown in FIG. 2.

Furthermore, referring to FIG. 4*b*, another variant embodiment of the fluid injector is shown. In a fluid injector 100*b* as shown in FIG. 4*b*, the shape of a second through hole 141*b* is different from that of the second through hole 141 as shown in FIG. 2. The diameter of one end, communicating with the first through hole 114, of the second hole 141*b* is substantially larger than that of the other end of the second through hole 141*b*.

Figure 4C:
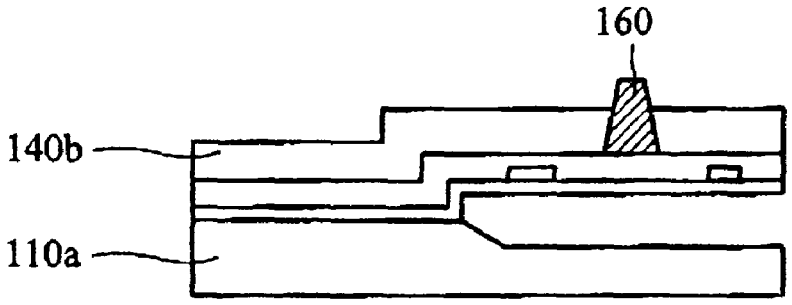
Figure 4D:
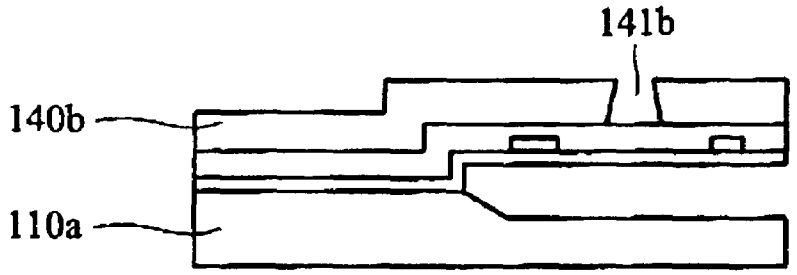

To obtain the fluid injector 100*b* as shown in FIG. 4*b*, a positive or negative photoresist 160 is used to obtain the shape as shown in FIG. 4*c*. As shown in FIG. 4*c*, the width of the top portion of the photoresist 160 is smaller than its bottom. After the processes of electroforming and photoresist removal, the metal layer 140*b* can be formed as shown in FIG. 4*d*. Finally, by dry-etching, the second through hole 141*b* is formed like a tapered hole as shown in FIG. 4*b*.

Since the second through hole 141*b* in the fluid injector 100*b* is formed like a tapered hole as shown in FIG. 4*b*, the injecting direction of the fluid can be more definite.

Second Embodiment

Figure 5:
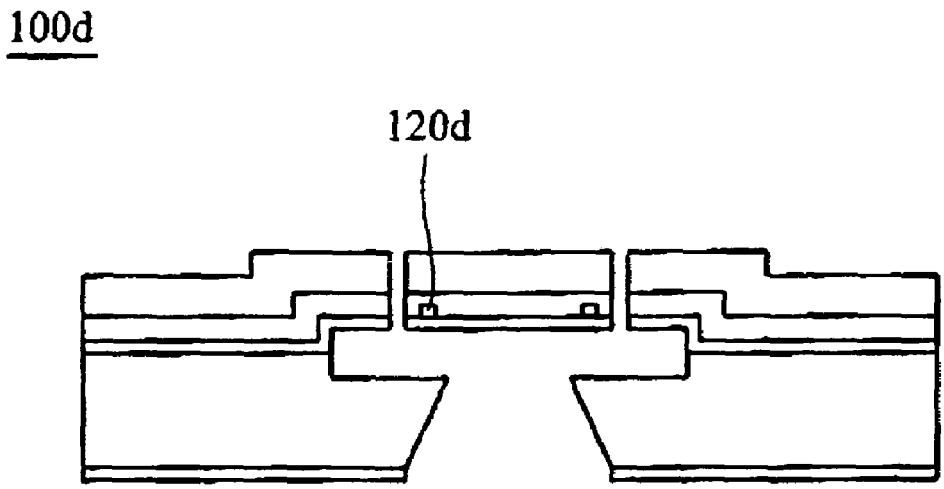
FIG. 5 is a schematic view of a fluid injector as disclosed in a second embodiment of this invention.

FIG. 5 is a schematic view of a fluid injector 100*d* as disclosed in a second embodiment of this invention. The difference between the fluid injector 100*d* of this embodiment and that of the first embodiment is that the bubble generator 120 comprises only one heater 120*d*. The other components of this embodiment are the same as those of the first embodiment; therefore, their description is omitted.

Since the fluid injector of this embodiment is also provided with the metal layer, it can obtain the same effect as the first embodiment. That is, the structural strength of the whole fluid injector can be enhanced, and the heat remaining in the bubble generator can be quickly transferred away, and the injecting direction of the fluid can be more definite.

Third Embodiment

Figure 6:
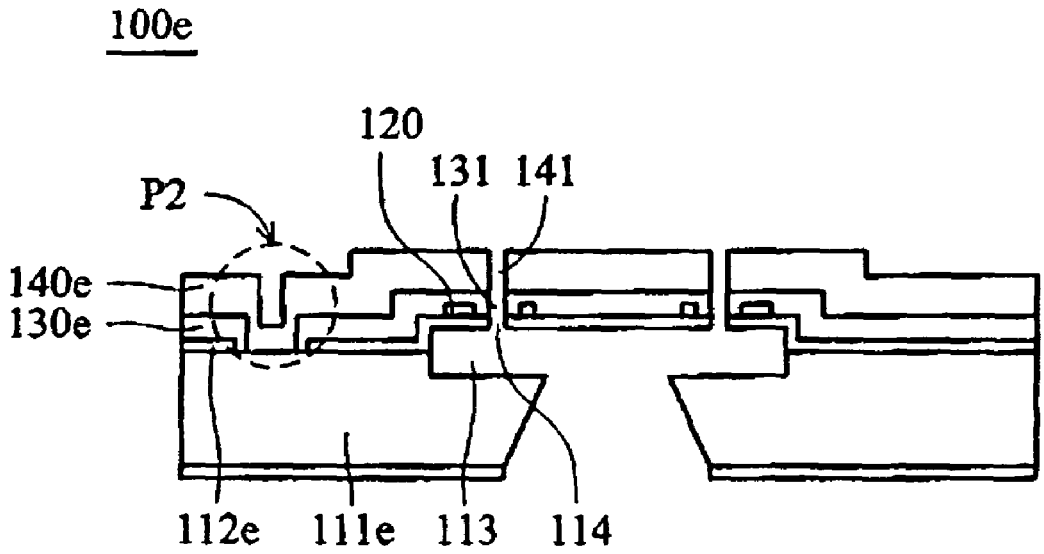
FIG. 6 is a schematic view of a fluid injector as disclosed in a third embodiment of this invention.

Referring to FIG. 6, a fluid injector 100*e*, as disclosed in a third embodiment of this invention, is shown. In this embodiment, the fluid injector 100*e* comprises a silicon substrate 111*e*, a structural layer 112*e*, a first through hole 114, a bubble generator 120, a passivation layer 130*e*, a metal layer 140, and a second through hole 141. It is noted that the first through hole 114, the bubble generator 120, and the second through hole 141 are the same as those of the first embodiment; therefore, their description is omitted, and their reference numbers are identical to those of the first embodiment.

Figure 7A:
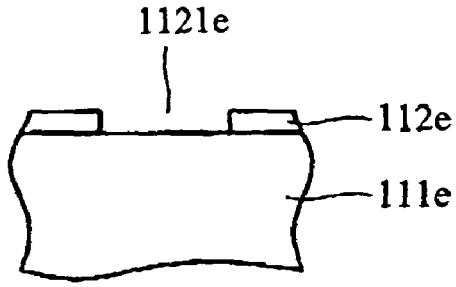
FIG. 7*a*, FIG. 7*b*, FIG. 7*c*, and FIG. 7*d* are schematic views that show a method for manufacturing the fluid injector as shown in FIG. 6, wherein only a part P2 is shown.
Figure 7B:
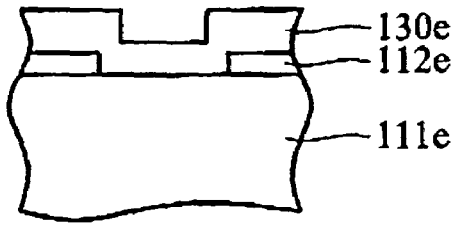
Figure 7C:
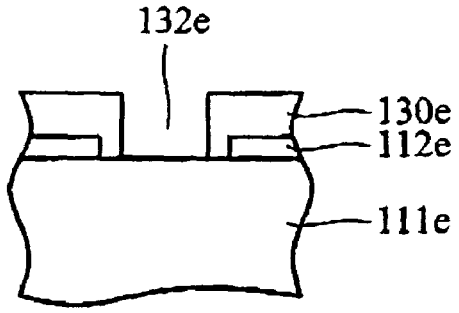

The difference between this embodiment and the first embodiment are that in this embodiment, a third through hole 1121*e* is formed in the structural layer 112*e* as shown in FIG. 7*a*, and a fourth through hole 132*e* is formed in the passivation layer 13O*e* as shown in FIG. 7*c*. The fourth through hole 132*e* corresponds to the third through hole 1121*e*, and the metal layer 140*e* is directly connected with the silicon substrate 111*e* via the fourth through hole 132*e*.

The difference between the method for manufacturing the fluid injector 100*e* of this embodiment and that of the first embodiment are described as follows.

Figure 7D:
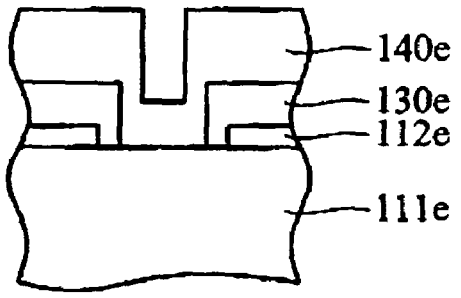

After the structural layer 112*e* is formed on the silicon substrate 111*e*, a third through hole 1121*e* is formed in the structural layer 112*e* as shown in FIG. 7*a*. Then, a passivation layer 130*e* is formed on the structural layer 112*e* as shown in FIG. 7*b*, and a fourth through hole 132*e* is formed in the passivation layer 130*e* as shown in FIG. 7*c*. Finally, a metal layer 140*e* is formed on the passivation layer 130*e* as shown in FIG. 7*d*.

In this embodiment, since the metal layer 140*e* is directly connected with the silicon substrate 111*e* via the fourth through hole 132*e*, the effect of the heat dissipation can be enhanced.

Since the fluid injector of this embodiment is also provided with a metal layer, it can obtain the same effect as the first embodiment. That is, the structural strength of the whole fluid injector can be enhanced, and heat remaining in the bubble generator can be quickly transferred away, and the injecting direction of the fluid can be more definite.

Fourth Embodiment

Figure 8:
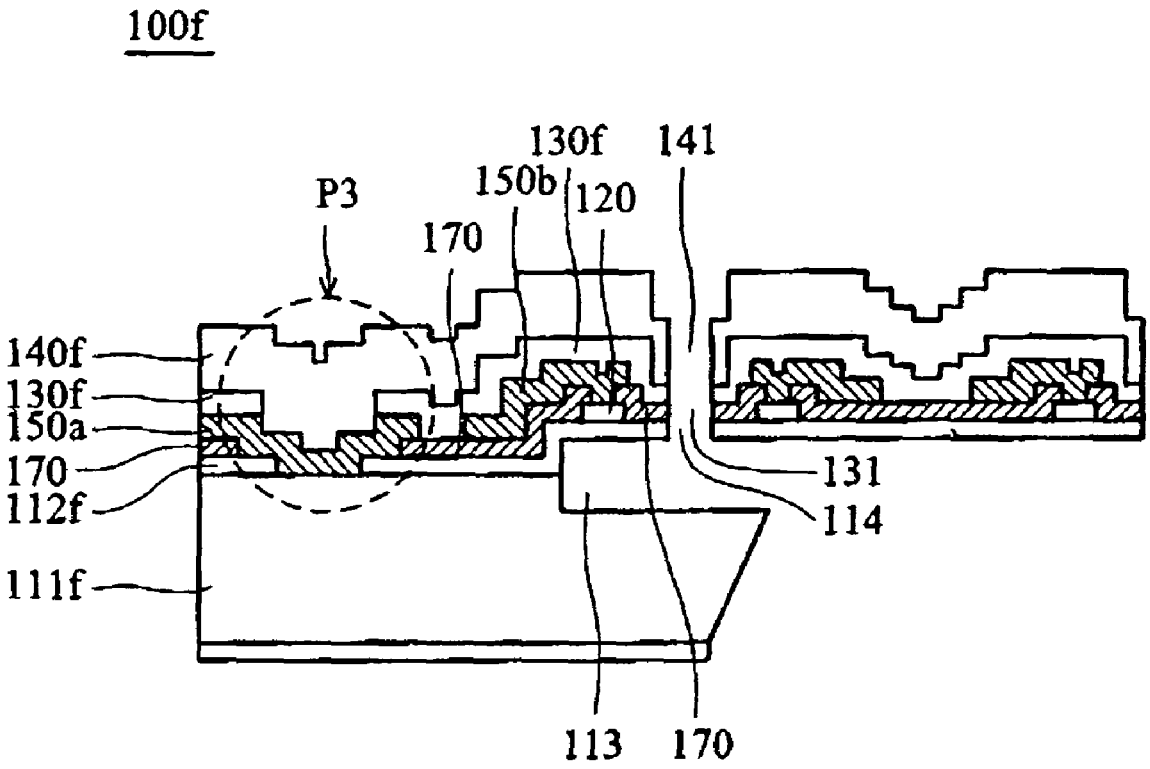
FIG. 8 is a schematic view of a fluid injector as disclosed in a fourth embodiment of this invention.
Figure 9A:
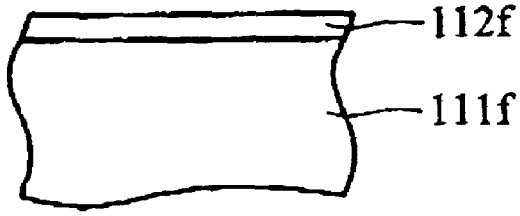
FIG. 9*a*, FIG. 9*b*, FIG. 9*c*, FIG. 9*d*, FIG. 9*e*, and FIG. 9*f* are schematic views that show a method for manufacturing the fluid injector as shown in FIG. 8, wherein only a part P3 is shown.

Referring to FIG. 8, a fluid injector 100*f*, as disclosed in a fourth embodiment of this invention, is shown. In this embodiment, the fluid injector 100*f* comprises a silicon substrate 111*f*, a structural layer 112*f*, a first through hole 114, a bubble generator 120, a passivation layer 130*f*, a metal layer 140*f*, second through hole 141, an adhesion layer 150*a*, and a dielectric layer 170. It is noted that the first through hole 114, the bubble generator 120, and the second through hole 141 are the same as those of the first embodiment; therefore, their description is omitted, and their reference numbers are identical to those of the first embodiment. Also, the structural layer 112*f*, the passivation layer 130*f*, and the metal layer 140*f* are the same as those of the third embodiment; therefore, their description is omitted The difference between this embodiment and the third embodiment is that in this embodiment, the fluid injector 100*f* further comprises the adhesion layer 150*a* and the dielectric layer 170. The adhesion layer 150*a* and the dielectric layer 170 are disposed between the structural layer 112*f* and the metal layer 140*f*. The adhesion layer 150*a* is connected with the metal layer 140*f* via a fourth through hole 132*f* in the passivation layer 130*f* as shown in FIG. 9*e*, and is connected with the silicon substrate 111*f* via a third through hole 1121*f* in the structural layer 112*f* as shown in FIG. 9*a*. Thus, the connection between the metal layer 140*f* and the silicon substrate 111*f* can be enhanced.

It is understood that the adhesion layer 150*a* may be Al. Also, it is noted that since the adhesion layer 150*a* is provided with electric conductivity, it cannot be in contact with the bubble generator 120. However, based on the manufacturing process, a wiring layer 150*b* is formed when the adhesion layer 150*a* is formed, but a gap must be formed therebetween.

The difference between the method for manufacturing the fluid injector 100*f* of this embodiment and that of the first embodiment follows.

Figure 9B:
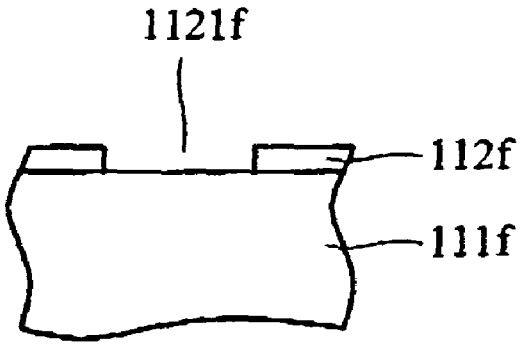
Figure 9C:
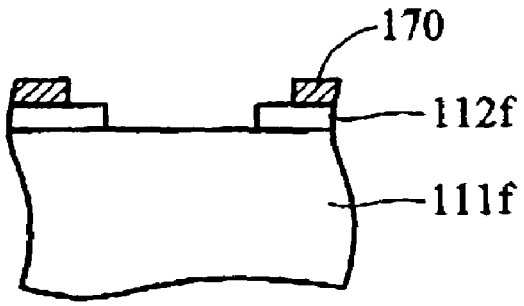
Figure 9D:
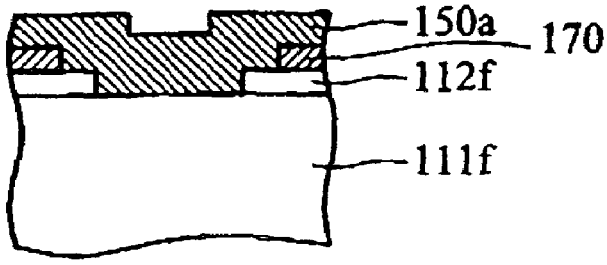
Figure 9E:
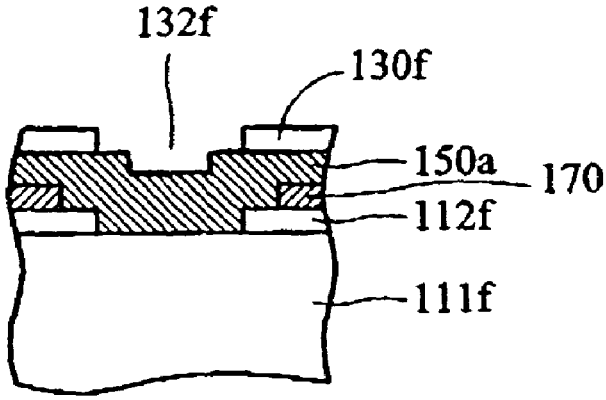
Figure 9F:
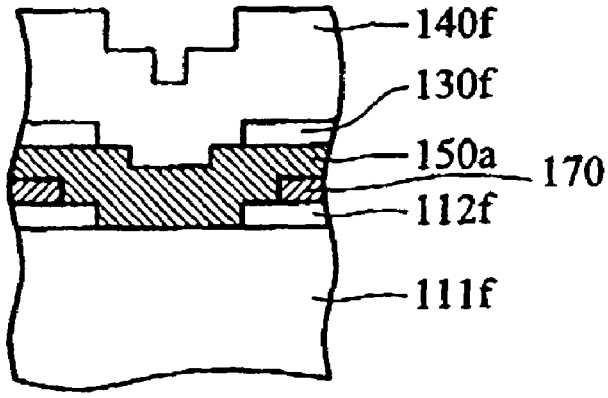

After the structural layer 112*f* is formed on the silicon substrate 111*f* as shown in FIG. 9*a*, a third through hole 1121*f* is formed in the structural layer 112*f* as shown in FIG. 9*b*. Then, a dielectric layer 170 is formed on the structural layer 112*f* as shown in FIG. 9*c*, and an adhesion layer 150*a* is formed on the dielectric layer 170 as shown in FIG. 9*d*. After a passivation layer 130*f* is formed on the adhesion layer 150*a*, a fourth through hole 132*f* is formed in the passivation layer 130*f* as shown in FIG. 9*e*. Finally, a metal layer 140*f* is formed on the passivation layer 130*f* as shown in FIG. 9*f*.

In this embodiment, the metal layer 140*f* is stably connected with the silicon substrate 111*f* due to the adhesion layer 150*a*.

Since the fluid injector of this embodiment is also provided with the metal layer, it can obtain the same effect as the first embodiment. That is, the structural strength of the whole fluid injector can be enhanced, and the heat remaining in the bubble generator can be quickly transferred away, and the injecting direction of the fluid can be more definite.

While the invention has been particularly shown and described with reference to preferred embodiments, it will be readily appreciated by those of ordinary skill in the art that various changes and modifications may be made without departing from the spirit and scope of the invention. It is intended that the claims be interpreted to cover the disclosed embodiment, those alternatives which have been discussed above, and all equivalents thereto.

What is claimed is:

1. A fluid injector comprising:

a base including a chamber and a surface;

a first through hole, communicating with the chamber, disposed in the base;

a bubble generator disposed on the surface near the first through hole outside the chamber of the base;

a passivation layer disposed on the surface;

a metal layer, defining a second through hole, disposed on the passivation layer outside the chamber; and a plurality of fins disposed on a surface of the metal layer away from the base to assist the metal layer in heat dissipation, wherein the second through hole communicates with the first through hole.

2. The fluid injector as claimed in claim 1, wherein the bubble generator comprises:

a first heater, disposed on the surface outside the chamber, for generating a first bubble in the chamber; and a second heater, disposed on the surface outside the chamber, for generating a second bubble in the chamber to inject fluid in the chamber, wherein the first heater and the second heater are located at opposite sides of the through hole.

3. The fluid injector as claimed in claim 1, wherein the bubble generator includes a heater.

4. The fluid injector as claimed in claim 1, wherein the diameter of one end, communicating with the first through hole, of the second hole is substantially larger than that of the other end of the second through hole.

5. The fluid injector as claimed in claim 1, further comprising: an adhesion layer, disposed between the base and the metal layer, for assisting in adhesion between the metal layer and the base.

6. The fluid injector as claimed in claim 5, wherein the adhesion layer is Al.

7. The fluid injector as claimed in claim 1, wherein the metal layer is Ni—Co alloy.

8. The fluid injector as claimed in claim 1, wherein the metal layer is Au.

9. The fluid injector as claimed in claim 1, wherein the metal layer is Au—Co alloy.

10. The fluid injector as claimed in claim 1, wherein the base comprises: a silicon substrate; and a structural layer disposed on the silicon substrate to form the chamber therebetween.

11. The fluid injector as claimed in claim 10, wherein the structural layer defines a third through hole, and the passivation layer defines a fourth through hole corresponding to the third through hole, and the metal layer is directly connected with the silicon substrate via the fourth through hole.

12. The fluid injector as claimed in claim 10, wherein the structural layer defines a third through hole, and the passivation layer defines a fourth through hole corresponding to the third through hole, and the base further comprises:

an adhesion layer, disposed on the structural layer and located between the passivation layer and the structural layer, abutting the silicon substrate via the third through hole and abutting the metal layer via the fourth hole to assist in adhesion between the metal layer and the silicon substrate.

13. The fluid injector as claimed in claim 12, wherein the adhesion layer is Al.

14. A fluid injector comprising:

a base including a chamber and a surface;

a first through hole, communicating with the chamber, disposed in the base;

a bubble generator disposed on the surface near the first through hole outside the chamber of the base;

a passivation layer disposed on the surface;

a metal layer disposed on the passivation layer outside the chamber to dissipate heat; and a plurality of fins disposed on a surface of the metal layer away from the base to assist the metal layer in heat dissipation.

15. The fluid injector as claimed in claim 14, further comprising: an adhesion layer, disposed between the base and the metal layer, to assist in adhesion between the metal layer and the base.

16. The fluid injector as claimed in claim 15, wherein the adhesion layer is conductive material.

17. The fluid injector as claimed in claim 14, wherein the metal layer is Ni—Co alloy.

18. The fluid injector as claimed in claim 14, wherein the metal layer is Au.

19. The fluid injector as claimed in claim 14, wherein the metal layer is Au—Co alloy.

20. The fluid injector as claimed in claim 14, wherein the base comprises:

a silicon substrate; and a structural layer disposed on the silicon substrate to form the chamber therebetween.

21. The fluid injector as claimed in claim 20, wherein the structural layer defines a second through hole, and the passivation layer defines a third through hole corresponding to the second through hole, and the metal layer is directly connected with the silicon substrate via the third through hole.

22. The fluid injector as claimed in claim 20, wherein the structural layer defines a second through hole, and the passivation layer defines a third through hole corresponding to the second through hole, and the base further comprises: an adhesion layer, disposed on the structural layer and located between the passivation layer and the structural layer, abutting the silicon substrate via the second through hole and abutting the metal layer via the third hole to assist in adhesion between the metal layer and the silicon substrate.

* * * * *